US007513958B2

(12) United States Patent
Kula et al.

(10) Patent No.: US 7,513,958 B2
(45) Date of Patent: Apr. 7, 2009

(54) HYDROCARBON GAS MIXTURE FOR THE UNDER-PRESSURE CARBURIZING OF STEEL

(75) Inventors: Piotr Kula, Lodz (PL); Jozef Olejnik, Swiebodzin (PL); Paul Heilman, Maintul (DE)

(73) Assignees: Seco / Warwick S.A., Swiebodzin (PL); Politechnika Lodzka, Lodz (PL)

( * ) Notice: Subject to any disclaimer, the term of this patent is extended or adjusted under 35 U.S.C. 154(b) by 364 days.

(21) Appl. No.: 10/531,690

(22) PCT Filed: Jul. 2, 2003

(86) PCT No.: PCT/PL03/00066

§ 371 (c)(1),
(2), (4) Date: Apr. 15, 2005

(87) PCT Pub. No.: WO2004/035853

PCT Pub. Date: Apr. 29, 2004

(65) Prior Publication Data

US 2006/0102254 A1 May 18, 2006

(30) Foreign Application Priority Data

Oct. 21, 2002 (PL) ..... 356754

(51) Int. Cl.
*C23C 8/00* (2006.01)

(52) U.S. Cl. ..... 148/223; 148/235

(58) Field of Classification Search ..... 148/223, 148/218, 235
See application file for complete search history.

(56) References Cited

U.S. PATENT DOCUMENTS

| | | | | |
|---|---|---|---|---|
| 5,580,397 | A * | 12/1996 | Meyer et al. | 148/218 |
| 5,702,540 | A | 12/1997 | Kubota | |
| 6,187,111 | B1 | 2/2001 | Waka et al. | |

FOREIGN PATENT DOCUMENTS

| | | |
|---|---|---|
| EP | 0 818 555 A1 | 1/1998 |
| EP | 0 882 811 B1 | 12/1998 |
| JP | A 2000-001765 | 1/2000 |
| JP | A 2002-194526 | 7/2002 |

OTHER PUBLICATIONS

Kula et al., "New Vacuum Carburizing Technology," Heat Treating Progress, 1(1), pp. 57-60, Feb.-Mar. 2001.
Sugiyama et al., "Vacuum carburizing with acetylene. (Heat Treating Progress)(heat engineering process)," Advanced Mat. 8 Processes, v. 155, No. 4, pp. 2-3, Apr. 1999.

* cited by examiner

*Primary Examiner*—Roy King
*Assistant Examiner*—Weiping Zhu
(74) *Attorney, Agent, or Firm*—Oliff & Berridge, PLC

(57) ABSTRACT

The subject of present invention relates to mixture for carburizing of steel products, mainly parts of machines, vehicles and every mechanical apparatus, used in vacuum furnaces. Present invention relates to mixture for under-pressure carburizing containing the carbon carrier comprising two unsaturated hydrocarbons, likely ethylene and acetylene, in volume ratio from 0.1 to 2.00. The carbon carrier can be further mixed with hydrogen or ammonia.

4 Claims, No Drawings

HYDROCARBON GAS MIXTURE FOR THE UNDER-PRESSURE CARBURIZING OF STEEL

This Application is a National Stage of Application No. PCT/PL2003/000066 filed Jul. 2, 2003, which claims benefit of Polish Patent Application No. 356754 filed Oct. 21, 2002. The entire disclosure of the prior application is hereby incorporated by reference herein in its entirety.

The object of the present invention relates to a mixture used in vacuum furnaces for under-pressure carburizing of steel products, mainly parts of machines, vehicles and all sorts of mechanical apparatuses.

From the U.S. Pat. No. 5,702,540 a process is known, in which a charge is processed under vacuum in the presence of a carbon carrier which contains unsaturated aliphatic hydrocarbons, where the pressure in the chamber shall not be higher than 1 kPa.

Another U.S. Pat. No. 6,187,111, uses gaseous ethylene as the carbon carrier and the pressure in the chamber shall be within the range of 1 to 10 kPa, whereas the charge shall have the temperature between 900° C. and 1100° C.

The patent EPO 0,882,811 is also known in which the carbon carrier is a hydrocarbon with a strict 1:1 carbon-to-hydrogen ratio.

To obtain the required carburizing result the carbon carrier, ethylene or acetylene, is introduced to a hot vacuum furnace chamber during the carburizing stage either in a continuous or a pulse manner. The carbon carrier can be introduced together with other chemically inert gases, e.g. nitrogen, argon, or active gases, e.g. hydrogen, in order to control the efficiency and cleanness of the carburizing process, as well as with active nitrogen carriers, e.g. ammonia, for carbonitriding of steel.

The main point and essence of the present invention is the mixture for under-pressure carburizing , which contains the carbon carrier in the form of two unsaturated hydrocarbons, having the volume ratio from 0.1 to 2.00, preferably from 0.15 to 2.0. The carbon carrier is preferably ethylene and acetylene. The carbon carrier can be further mixed with hydrogen or also with ammonia. In the case of mixing the carbon carrier with hydrogen, 0,7 to 1 volume by ratio should be maintained. For ammonia this ratio is 0.7 to 5.0.

The mixture according to the present invention is characterized by the effect of synergy of uniform carburizing of intricate shape workpieces, especially those with narrow and deep hollows of complicated shapes and recesses, and effective elimination of side-products of vacuum carburizing of steels such as soot and tar.

One of possible implementations of the mixture for under-pressure carburizing according to the present invention is illustrated by the following examples, while the surfaces of the samples are shown in the figure enclosed.

EXAMPLE 1

A furnace chamber of the size 200×200×400 mm was charged with workpieces made of low carbon steel grades together with three samples made of 16CrMn5 with deep, narrow hollows of intricate shapes. The total surface area of the charge was 0.4 $m^2$. After heating under vacuum up to 950° C. the carbon carrier was introduced—comprising ethylene and acetylene in the volume ratio 1, mixed with hydrogen in the volume ratio 1,17—with constant flow rate 190 l/hr and pressure pulse was generated in the furnace chamber within the range of 3 to 8 mbar. Steel workpieces were heated 20 minutes under this atmosphere at the temperature of 950° C., then under vacuum for 10 minutes and they were then cooled down to the ambient temperature. On the surface of all the samples including the entire cross section of the deep hollow of intricate shape, the carburizing layer was formed. The layer was of a uniform perlitic structure without precipitation of secondary carbides and of a uniform depth of 0.44±0.05 mm measured according to the limit structure of 50% perlite and 50% ferrite. No evidence of soot and tar was found either on the surface of workpieces after carburizing or in the furnace chamber interior.

EXAMPLE 2

A furnace chamber of the size 200×200×400 mm was charged with workpieces made of low carbon steel grades together with three samples with made of 17CrNi with deep, narrow hollows of intricate shapes. The total surface area of the charge was 0.4 $m^2$. After heating under vacuum up to 950° C. the carbon carrier was introduced—comprising ethylene and acetylene in the volume ratio 1.83, mixed with hydrogen in the volume ratio 1,45—with constant flow rate 208 l/hr and pressure pulse was generated in the furnace chamber within the range of 3 to 8 mbar. Steel workpieces were heated 20 minutes under this atmosphere at the temperature of 950° C., then under vacuum for 30 minutes, and then fast cooled to the ambient temperature under 6 bar nitrogen pressure. On the surface of all the samples including the entire cross section of the deep hollow of intricate shape, the carburizing layer was formed. The layer was of a uniform martenzitic structure without precipitation of secondary carbides and of a uniform depth of 0.46±0.05 mm measured according to the minimum limit hardness of 500 $HV_{01}$. No evidence of soot and tar was found either on the surface of workpieces after carburizing or in the furnace chamber interior.

The invention claimed is:

1. A mixture including a carbon carrier for under-pressure carburizing, wherein the carbon carrier comprises acetylene and ethylene in a ratio of 0.55 to 2.0, and wherein the mixture additionally comprises either hydrogen in a ratio from 0.7 to 1.6 to the carbon carrier or ammonia in a ratio from 0.7 to 5.0 to the carbon carrier.

2. The mixture for under-pressure carburizing according to claim 1, wherein the proportion of acetylene to ethylene is from 0.55 to 1.0.

3. The mixture for under-pressure carburizing according to claim 1, wherein the mixture further includes an additional components comprising at least one chemically inert gases.

4. The mixture for under-pressure carburizing according to claim 3, wherein the chemically inert gases comprise nitrogen or argon.

* * * * *